US007244238B2

(12) United States Patent
March et al.

(10) Patent No.: US 7,244,238 B2
(45) Date of Patent: Jul. 17, 2007

(54) KNEE EXTENSION APPARATUS

(75) Inventors: Phillip March, Zeeland, MI (US); John Hop, Zeeland, MI (US); Sandi Karafa, Grand Haven, MI (US)

(73) Assignee: Doctor's Orders, Zeeland, MI (US)

( * ) Notice: Subject to any disclaimer, the term of this patent is extended or adjusted under 35 U.S.C. 154(b) by 346 days.

(21) Appl. No.: 10/870,715

(22) Filed: Jun. 17, 2004

(65) Prior Publication Data

US 2005/0080371 A1 Apr. 14, 2005

Related U.S. Application Data

(60) Provisional application No. 60/479,553, filed on Jun. 18, 2003.

(51) Int. Cl.
*A61H 1/00* (2006.01)

(52) U.S. Cl. ..... 601/33; 601/34; 128/845

(58) Field of Classification Search ..... 601/5, 601/23, 24, 33–35; 602/23, 26, 33–35; 482/79, 482/131, 907; 5/650; 128/845, 875, 872; 606/241

See application file for complete search history.

(56) References Cited

U.S. PATENT DOCUMENTS

| | | | | |
|---|---|---|---|---|
| 661,812 | A * | 11/1900 | McKown et al. | 602/39 |
| 5,025,802 | A * | 6/1991 | Laico et al. | 606/241 |
| 5,687,742 | A * | 11/1997 | Johnson | 5/650 |
| 6,962,570 | B2 * | 11/2005 | Callanan et al. | 601/5 |
| 7,036,169 | B2 * | 5/2006 | Marshall | 5/650 |
| 2003/0200972 | A1 * | 10/2003 | Crutchfield | 128/845 |

* cited by examiner

*Primary Examiner*—Quang D. Thanh
(74) *Attorney, Agent, or Firm*—Watson IP Group, PLC; Jovan N. Jovanovic; Vladan M. Vasiljevic

(57) ABSTRACT

A knee extension apparatus comprising a base, a pad assembly and at least one strap member. The base includes a first end and a second end. The pad assembly includes a pad member and a mounting assembly. The mounting assembly facilitates attachment of the pad member in at least two different locations along the upper surface of the base, proximate the second end thereof, so as to vary the distance between the first end and the pad member. The at least one strap member is associated with the base and positioned between the first end and the second end of the base member. The at least one strap member is capable of encircling a leg of a patient proximate a knee portion thereof.

18 Claims, 4 Drawing Sheets

KNEE EXTENSION APPARATUS

CROSS REFERENCE TO RELATED APPLICATION

This application claims the benefit of U.S. Provisional Application Ser. No. 60/479,553 filed Jun. 18, 2003 entitled "Knee Extension Apparatus," the entire specification of which is incorporated by reference.

BACKGROUND OF THE INVENTION

1. Field of the Invention

The present invention relates in general to a physical therapy device, and more particularly, to a knee extension apparatus which facilitates and assists a patient to gradually extend the knee.

2. Background Art

Many injuries of the knee and lower extremities result in an inability of a patient to fully extend the knee. As such, patients are generally required to undertake a plurality of hours of physical therapy wherein the therapist exercises and treats the knee. As a part of this therapy, the patient is often placed in a number of different devices designed to assist the patient with the extension of the knee.

Among other problems, such devices are often difficult to configure for a specific user, and, are often difficult to fit for a plurality of users. For example, users that are not of a narrow range of height (and leg length) often experience difficulties with respect to proper usage and comfort of prior art devices. Accordingly, treatment is generally adversely affected.

In addition, prior art devices are made from various foams. While such a material is generally acceptable for certain components, it often lacks the necessary rigidity for use in other components such as the base thereof. As a result, treatment is again adversely affected.

Accordingly, it is an object of the invention to provide for a knee extension apparatus that overcomes the deficiencies of the prior art.

This an other objects will become apparent in light of the specification and claims appended hereto.

SUMMARY OF THE INVENTION

The invention comprises a knee extension apparatus for assisting a patient to extend a knee. The knee extension comprises a base, a pad assembly and at least one strap member. The base includes an upper surface, a lower surface, a first end and a second end. The pad assembly includes a pad member and a mounting assembly. The mounting assembly facilitates attachment of the pad member in at least two different locations along the upper surface of the base, proximate the second end thereof, so as to vary the distance between the first end and the pad member. The at least one strap member is associated with the base and positioned between the first end and the second end of the base member. The at least one strap member capable of retaining a leg of a patient along with the base proximate a knee portion thereof.

In a preferred embodiment, the upper surface of the first end of the base includes an inclined surface region, to, in turn, provide a tapered end proximate the first end. In another preferred embodiment, the base comprises a wood based material.

In yet another preferred embodiment, the upper surface is substantially planar along a majority of the length thereof.

In another preferred embodiment, the base further comprises a plurality of slots extending therethrough. The plurality of slots configured to receive the at least one strap member, to in turn, couple the at least one strap member to the base.

In one such preferred embodiment, the plurality of slots comprise a plurality of pairs of corresponding slots positioned proximate the outer edges of the base.

In another preferred embodiment, the mounting assembly further includes a mating structure and a fastener. In one such embodiment, the mating structure comprises a slot, a pin and a fastener. The slot is associated with one of the base and the pad member. The pin is associated with the other of the base and the pad member. The pin is capable of slidable movement along the slot. The fastener is capable of releasably retaining the pin in a desired orientation. In another such preferred embodiment, the slot is associated with the base, and the pin is associated with the pad member. In another preferred embodiment, the fastener comprises a threaded fastener along with a wing nut.

Preferably, the pad member includes a top surface, a bottom surface and at least one side surface. In one such embodiment, the top surface of the pad member is substantially planar. In such an embodiment, the top surface of the pad member is substantially parallel to the upper surface of the base. In another such embodiment, the pad member includes at least one of rigidifier positioned along the at least one side surface.

In a preferred embodiment, the pad member includes an upper pad component and a lower pad component. The density of the upper pad component is lower than the density of the lower pad component.

In another preferred embodiment, the pad member includes a cover extending thereover.

Preferably, the strap member includes an elongated member, a fastener and a padding member.

In a preferred embodiment, the mounting assembly facilitates attachment of the pad member to the base at a plurality of discrete locations.

In another preferred embodiment, the mounting assembly facilitates attachment of the pad member to the base at any location along a predetermined range of the base.

In another preferred embodiment, the mounting assembly facilitates slidable attachment of the pad member to the base at any location along a predetermined range of the base.

BRIEF DESCRIPTION OF THE DRAWINGS

The invention will now be described with reference to the drawings wherein.

DETAILED DESCRIPTION OF THE INVENTION

Figure 1:
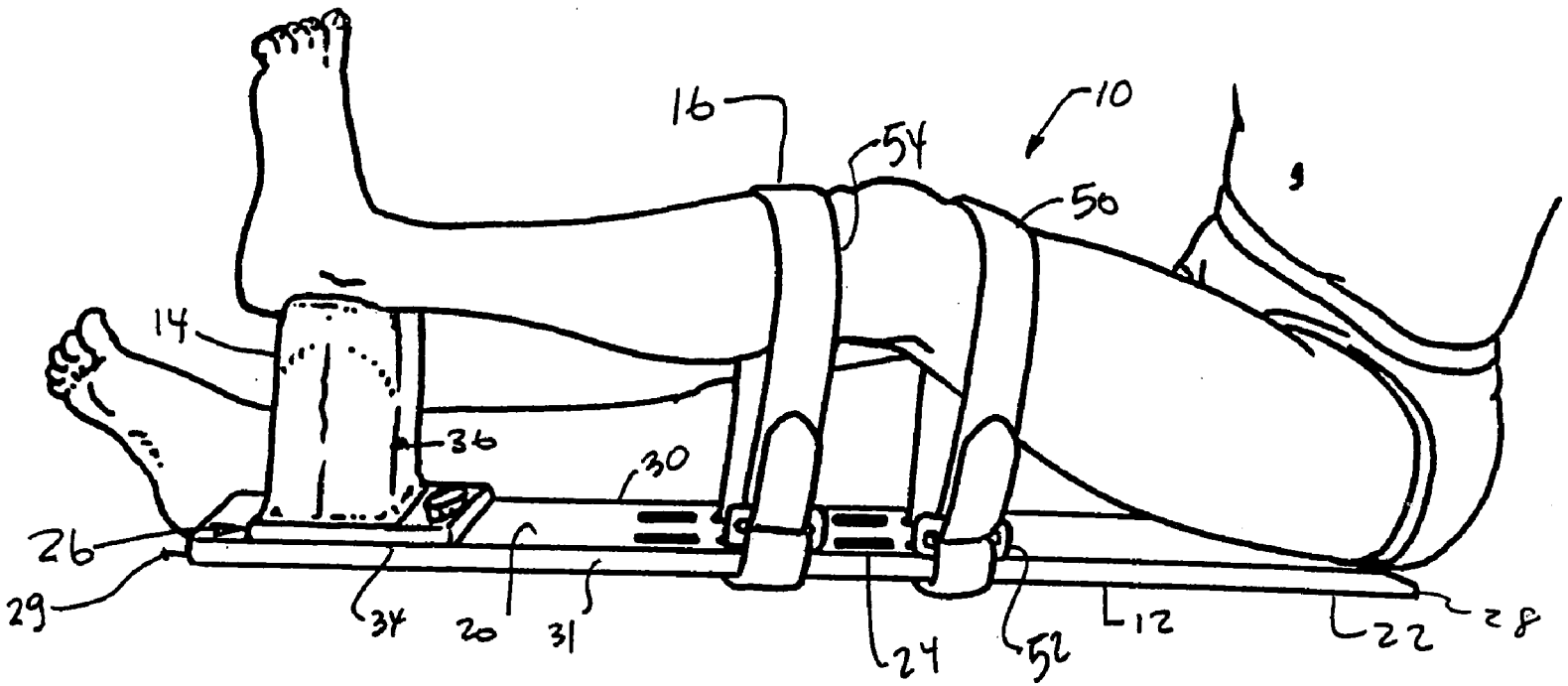
FIG. 1 of the drawings comprises a side elevational view of the invention, showing, in particular, the use thereof.
Figure 2:
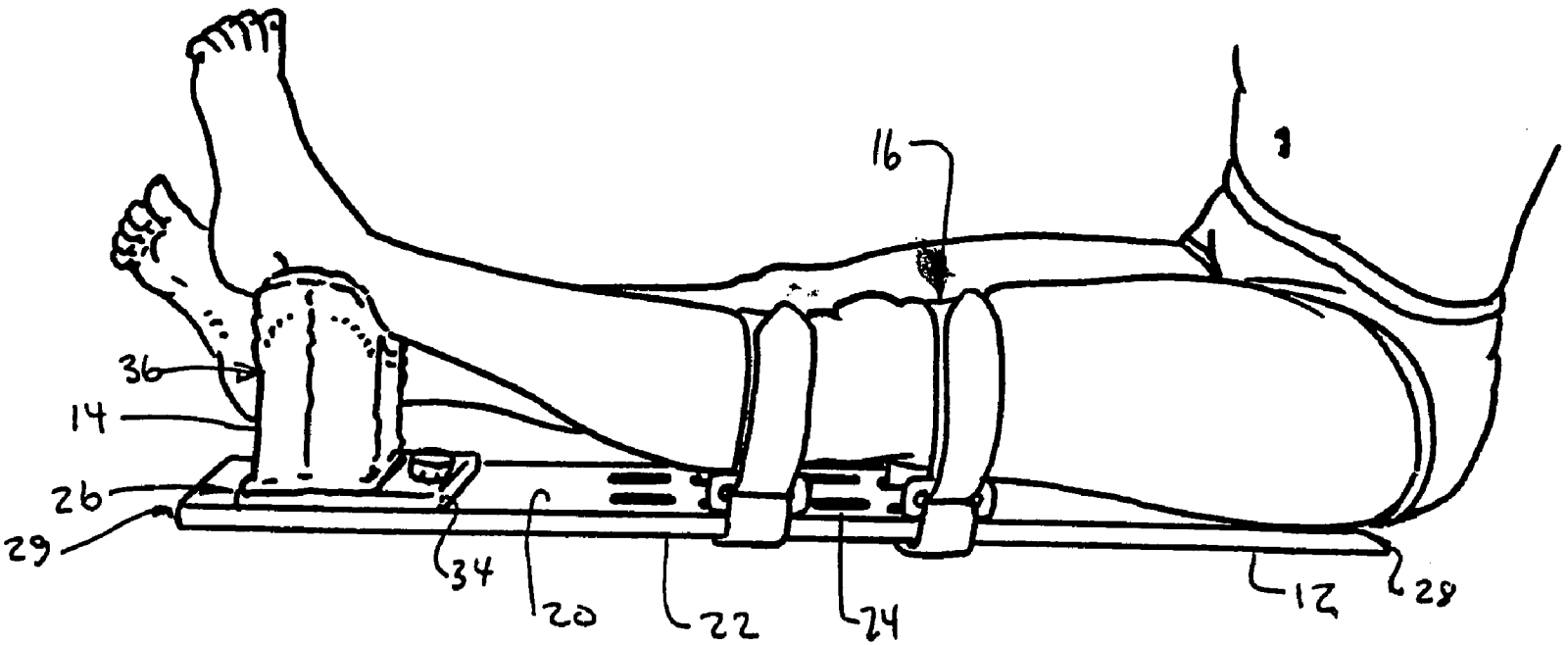
FIG. 2 of the drawings comprises a bottom plan view of the invention, showing, in particular, the use thereof.

While this invention is susceptible of embodiment in many different forms, there is shown in the drawings several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters. In addition, it will be understood that the drawings are merely representations of the present invention, and some of the components may have been distorted from actual scale for purposes of pictorial clarity.

Referring now to the Figures, and in particular to FIG. 1, knee extension apparatus 10 comprises base 12, pad assembly 14 and strap members, such as strap member 16. Base 12 comprises an elongated member having upper surface 20, lower surface 22, strap slots, such as strap slots 24 and pad receiving assembly 26. Upper surface 20 and lower surface 22 are substantially parallel to each other and extend from first end 28 to second end 29. Generally, the two surfaces are substantially parallel, however, near first end 28, the upper surface is inclined and tapered toward the lower surface, so as to enhance the comfort of the user.

Strap slots 24 are positioned in opposing pairs proximate side edges 30, 31 of base 12. Preferably, strap slots 24 extend through base 12. The pairs of strap slots are positioned between first end 28 and second end 29, at strategic locations. In the embodiment shown, four corresponding pairs of strap slots are utilized, however, it is contemplated that a greater or lesser number of such slots can be utilized.

Preferably, base 12 comprises a rigid and substantially inflexible member. For example, base 12 may comprise a ½" plywood material, or other wood material that is between 2 and 6 feet (while not limited thereto). It is likewise contemplated that metals, alloys, polymers and composite alloys are suitable for use. Additionally, upper surface 20 may include a padding member to likewise aid with patient comfort. It will be understood that the invention is not limited to any particular material, as long as such material exhibits proper strength and/or durability.

Figure 3:
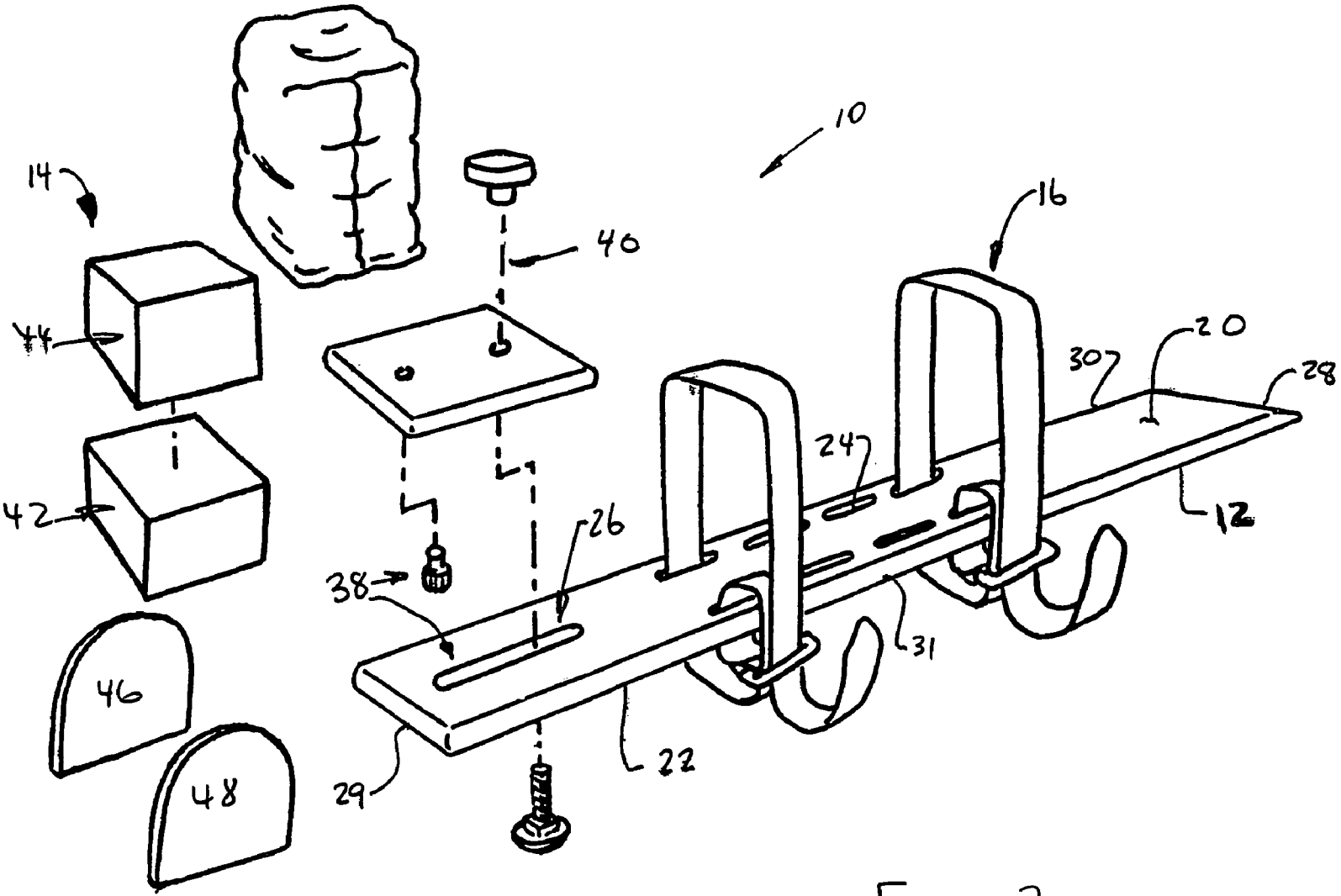
FIG. 3 of the drawings comprises an exploded view of the invention, showing.

Pad assembly 14 is shown in FIG. 3 as comprising mounting assembly 34 and pad member 36. Mounting assembly 34 includes mating structures 38 and fastener 40. Mounting assembly 34 comprises a substantially planar material which is positioned in overlying abutment with upper surface 20 of base 12. Mating structures 38 comprise a pin and a slot, one of which is associated with the mounting assembly, and the other of which is associated with the base. The pin and slot register with each other to facilitate proper mating thereof. To provide adjustability, the slots are substantially elongated such that they permit slidable movement of the pins therealong.

Figure 4:
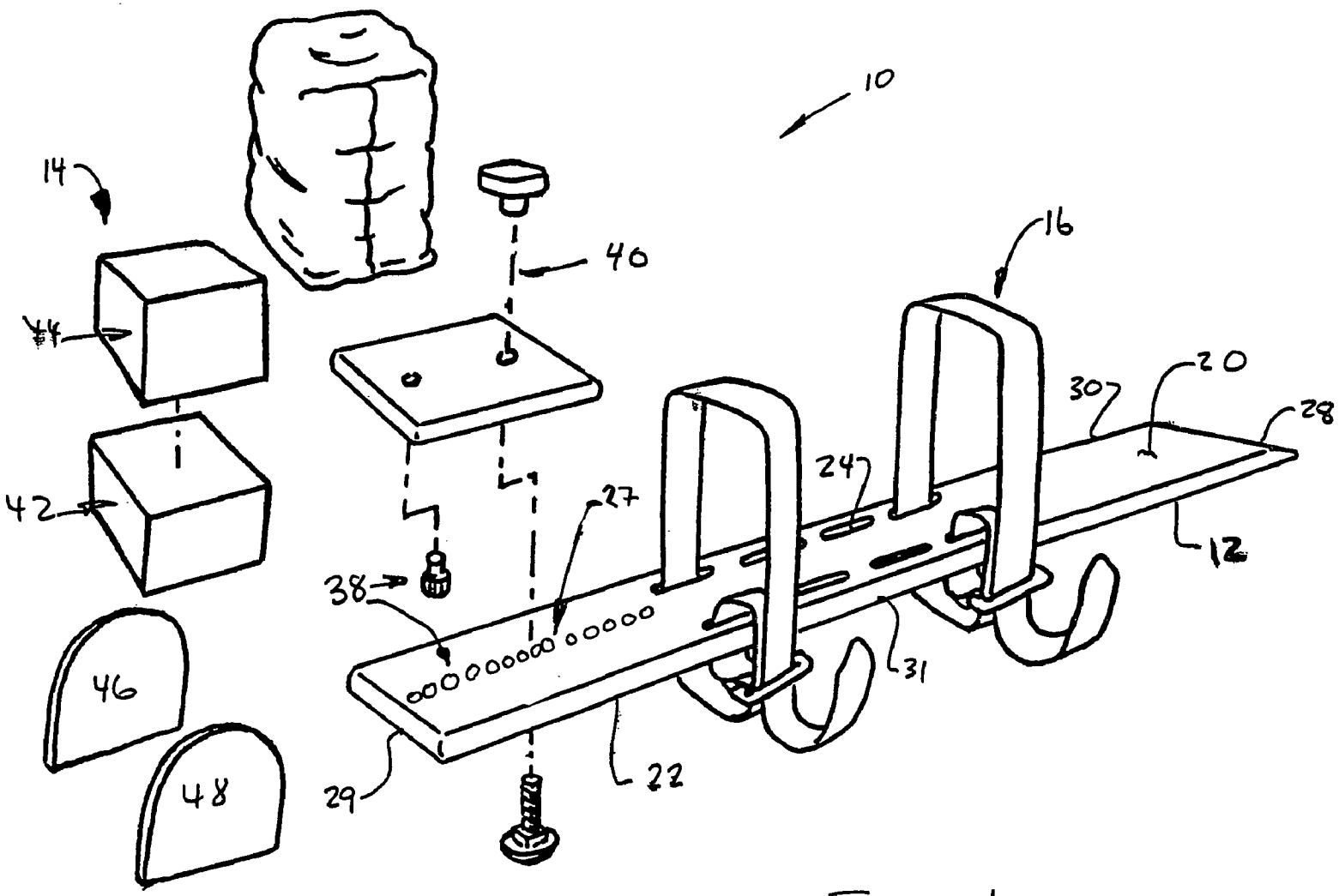
FIG. 4 of the drawings comprises an exploded view of another embodiment of the invention, showing an alternate mounting assembly.

Referring now to FIG. 4, it is likewise contemplated that the slot may be replaced with a plurality of openings spaced apart, such as opening 27, each of which is capable of receiving the pin and/or the fastener. In such an embodiment, the pad member is positionable at a plurality of discrete locations, whereas with the slot, a vast number of separate positions are possible along the range of the slot. Of course, any number of different structures are contemplated which allow for either multiple discrete positions or a continuum of positions within a certain range.

Fastener 40 comprises a threaded fastener along with a wing nut, or the like. The fastener 40 extends through each of the mounting assembly and the base member, and the wing nut can apply pressure to retain the two structures, releasably, in the desired configuration. Of course, other fasteners, such as hook and loop fasteners, adhesives, threaded members, clips, slots and tabs, just to name a few, are contemplated for use.

Pad member 36 comprises a substantially cubic member having a top surface, a bottom surface, and a plurality of side surfaces (i.e., four in the embodiment shown). Of course, the invention is not limited to a pad member of a specific structural shape (i.e., cubic, cylindrical, and other shapes are contemplated). The pad member extends upwardly from the mounting member such that the top surface of the pad member is spaced apart from base 12 about 8 to 15 inches. Of course, depending on the particular application (i.e., women, men, children, etc.), the height of the pad member can be varied. Generally, the top surface of the pad member is substantially planar, although the outer edges of the top surface may be slightly rounded (i.e., an outer fillet of about ¼") to preclude discomfort about the edges.

As is shown in FIGS. 3 and 4, structurally the pad member may comprise a lower pad component 42 and an upper pad component 44. The lower pad component generally comprises a stiffer material which provides additional rigidity functions. The upper pad component is generally a softer material which provides enhanced comfort to the user (i.e., a lower density). The upper pad and the lower pad may be sandwiched between rigidifiers, such as rigidifiers 46, 48 positioned on opposing sides thereof. The pad member may be covered with a suitable material, such as a felt or fleece material to further enhance comfort.

Strap members, such as strap member 16 is shown in FIG. 1 as comprising elongated member 50, fastener 52 and padding member 54. The fasteners are associated with opposing ends of the elongated member, such that the ends can be fastened to each other. For example, snaps or hook and loop fasteners are contemplated for use, as are other fasteners. Padding member 54 comprises a sleeve of a suitable cross-sectional area so as to facilitate the substantially flat placement of the elongated member therethrough. The elongated member is of a width that permits the placement of the elongated member through the slots thereof.

In operation, the fastener of the strap members is released such that the strap members do not form a substantially continuous loop. Next, the user's leg is positioned in the proper orientation. In particular, the user sits down such that first end 28 of base 12 is proximate the upper thigh region of the user. Next, the Achilles tendon region of the foot proximate the heel is positioned on the pad member of the pad assembly. The pad assembly can be manipulated and adjusted relative to base 12 until the foot is properly positioned relative to the pad member. Once properly positioned, the mounting assembly of the pad assembly is releasably fixed to base 12 by fastener 40.

Next, the strap members are inserted through desired opposing slots such that a strap member is positioned on either side of the knee of the user, proximate to the knee. Once positioned through the desired strap slots, the strap members are fastened to each other. The strap members can be tightened or loosened as needed to achieve the extending of the knee in a controlled manner.

By providing an adjustment between base 12 and pad member 36, the pad member can be positioned in a desired orientation, while first end 28 of the base member can interact with the desired portion of the upper thigh of the patient, to enhance comfort and to maximize the therapeutic results of therapy.

The foregoing description merely explains and illustrates the invention and the invention is not limited thereto except insofar as the appended claims are so limited, as those skilled in the art who have the disclosure before them will be able to make modifications without departing the scope of the invention.

What is claimed is:

1. A knee extension apparatus for assisting a patient to extend a knee, the knee extension apparatus comprising:

a base having an upper surface, a lower surface, a first end and a second end;

a pad assembly including a pad member and a mounting assembly, the mounting assembly facilitating attachment of the pad member in at least two different locations along the upper surface of the base, proximate the second end thereof, so as to vary the distance between the first end and the pad member, the mounting assembly further including a fastener and a mating structure comprising a slot associated with one of the base and the mounting assembly;

a pin associated with the other of the base and the mounting assembly, the pin capable of slidable movement along the slot; and wherein the fastener is capable of releasably retaining the pin in a desired orientation; and at least one strap member associated with the base and positioned between the first end and the second end of the base member, the at least one strap member is capable of retaining a leg of a patient along with the base proximate a knee portion thereof.

2. The knee extension apparatus of claim 1 wherein the upper surface of the first end of the base includes an inclined surface region, to, in turn, provide a tapered end proximate the first end.

3. The knee extension apparatus of claim 1 wherein the base comprises a wood based material.

4. The knee extension apparatus of claim 1 wherein the upper surface is substantially planar along a majority of the length thereof.

5. The knee extension apparatus of claim 1 wherein the base further comprises a plurality of slots extending therethrough, the plurality of slots configured to receive the at least one strap member, to in turn, couple the at least one strap member to the base.

6. The knee extension apparatus of claim 5 wherein the plurality of slots comprise a plurality of pairs of corresponding slots positioned proximate the outer edges of the base.

7. The knee extension apparatus of claim 1, wherein the slot is associated with the base, and the pin is associated with the mounting assembly.

8. The knee extension apparatus of claim 1 wherein the fastener comprises a threaded fastener along with a wing nut.

9. The knee extension apparatus of claim 1 wherein the pad member includes a top surface, a bottom surface and at least one side surface.

10. The knee extension apparatus of claim 9 wherein the top surface of the pad member is substantially planar.

11. The knee extension apparatus of claim 10 wherein the top surface of the pad member is substantially parallel to the upper surface of the base.

12. The knee extension apparatus of claim 9 wherein the pad member includes at least one of rigidifier positioned along the at least one side surface.

13. The knee extension apparatus of claim 1 wherein the pad member includes an upper pad component and a lower pad component, wherein the density of the upper pad component is lower than the density of the lower pad component.

14. The knee extension apparatus of claim 1 wherein the pad member includes a cover extending thereover.

15. The knee extension apparatus of claim 1 wherein the strap member includes an elongated member, a fastener and a padding member.

16. The knee extension apparatus of claim 1 wherein the mounting assembly facilitates attachment of the pad member to the base at a plurality of discrete locations.

17. The knee extension apparatus of claim 16 wherein the mounting assembly facilitates attachment of the pad member to the base at any location along a predetermined range of the base.

18. The knee extension apparatus of claim 1 wherein the mounting assembly facilitates slidable attachment of the pad member to the base at any location along a predetermined range of the base.

* * * * *